United States Patent [19]

Zeller

[11] Patent Number: 5,000,238

[45] Date of Patent: Mar. 19, 1991

[54] GOLF CLUB COVER

[76] Inventor: Henry O. Zeller, P.O. Box 13436, Rochester, N.Y. 14623

[21] Appl. No.: 478,748

[22] Filed: Feb. 12, 1990

Related U.S. Application Data

[63] Continuation of Ser. No. 342,309, Apr. 24, 1989, abandoned.

[51] Int. Cl.[5] ..... A63B 57/00

[52] U.S. Cl. ..... 150/160; 206/315.4

[58] Field of Search ..... 150/159, 160; 206/316.2, 316.4, 316.6; 16/293, DIG. 13

[56] References Cited

U.S. PATENT DOCUMENTS

| | | | |
|---|---|---|---|
| 2,128,546 | 8/1938 | Venmore | 150/160 X |
| 2,508,525 | 5/1950 | LeFevre | 150/160 |
| 2,705,039 | 3/1955 | Halter | 150/160 |
| 2,879,819 | 3/1959 | Turnbull | 206/315.4 |
| 3,117,609 | 1/1964 | Pio | 150/160 |
| 3,613,760 | 10/1971 | Koehnle | 150/160 |
| 3,628,215 | 12/1971 | Everburg | 16/293 |
| 3,664,399 | 5/1972 | Neff | 150/160 |
| 3,667,078 | 6/1972 | Distasio | 206/315.4 X |
| 3,892,267 | 7/1975 | Bibeau | 150/160 |
| 4,164,969 | 8/1979 | Dien | 206/315.4 |
| 4,173,241 | 11/1979 | Stock | 206/315.6 |
| 4,195,677 | 4/1980 | Hagg et al. | 150/160 |
| 4,368,768 | 1/1983 | Cunko, Jr. | 150/160 |
| 4,378,832 | 4/1983 | Thompson | 150/160 |

FOREIGN PATENT DOCUMENTS

| | | | |
|---|---|---|---|
| 1056999 | 2/1967 | United Kingdom | 16/DIG. 13 |

*Primary Examiner*—Sue A. Weaver

*Attorney, Agent, or Firm*—Robert J. Bird

[57] ABSTRACT

A cover for the head of a golf club includes a heel piece and a toe piece connected by a hinge over the club bottom to swing open and closed. The hinge includes a hinge axis and arms to selectively urge the cover pieces open and closed. The cover further includes guide tabs to hold the heel and toe pieces in registry when the cover is closed, a fastener to hold the cover on a golf bag when the club is in use, and a protruding lip to facilitate a grasp to open the cover.

4 Claims, 4 Drawing Sheets

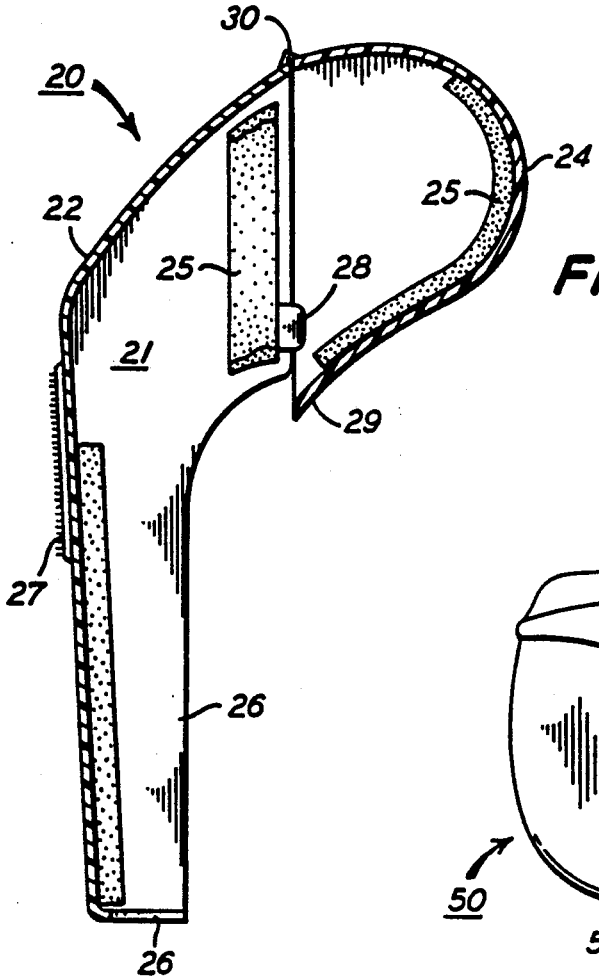
FIG. 6
FIG. 7
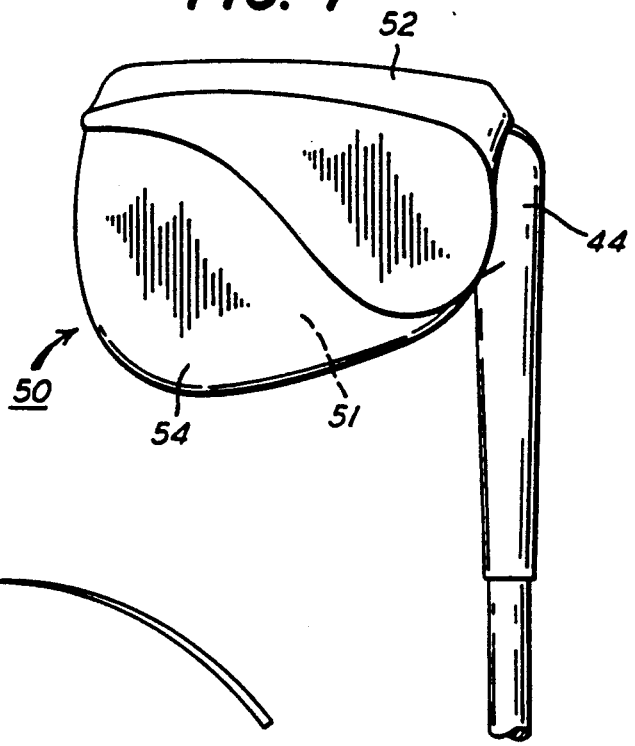
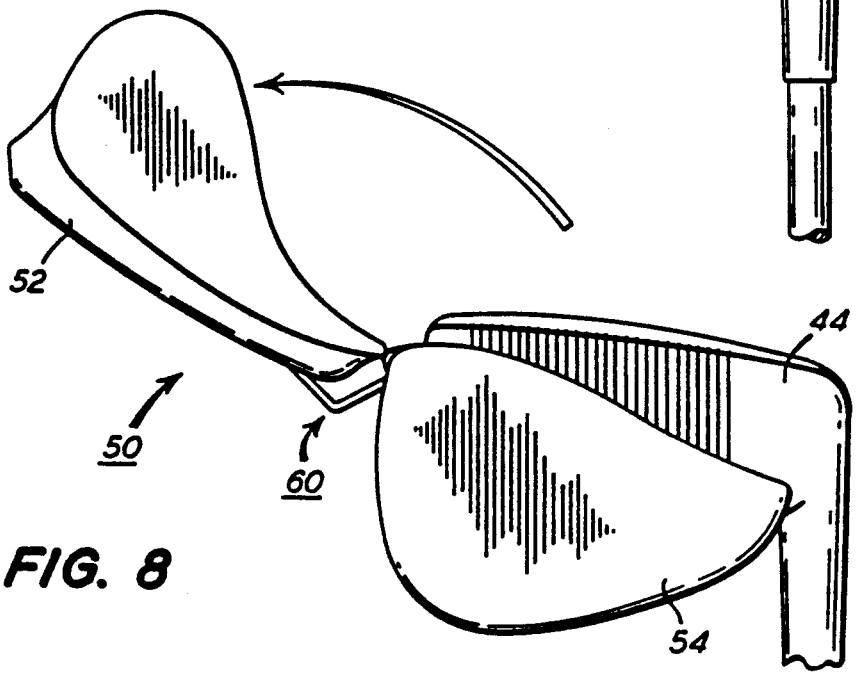
FIG. 8

GOLF CLUB COVER

This is a continuation of application Ser. No. 342,309 filed Apr. 24, 1989, now abandoned.

BACKGROUND OF THE INVENTION

The subject matter of this invention is a protective golf club cover.

For a long time in the prior art, golf club covers have typically been in the form of protective mittens, either knitted or leather, which slip on and off over the club head. Such covers or mittens are sometimes tied together in a set by a tie line, in which case the line tends to get tangled among the covers and clubs. Mittens may also be used individually, i.e. not connected by tie lines, in which case they are easily lost. Until recently, covers have been used only for woods, and primarily for the aesthetic purpose of protecting the finish on the wood.

More recently, golf clubs with graphite heads have come into use. Graphite club heads, both "iron" and "woods", are subject to chipping, nicking, and such like damage from contact with each other. This damage to graphite clubs is more than aesthetic; it is substantial. It is therefore desirable to provide protective cover for both irons and woods.

A soft cover such as a mitten may provide effective and adequate protection against scratches on a wood finish, but more effective protection is required to prevent chipping and such damage to graphite clubs. Shock loading is best absorbed by a hard and stiff shield.

SUMMARY OF THE INVENTION

In summary, the present invention is a cover for the head of a golf club, including a heel piece and a toe piece connected by a hinge over the club bottom to swing open and closed. The hinge includes a hinge axis and arms to selectively urge the cover pieces open and closed. The cover further includes guide tabs to hold the heel and toe pieces in registry when the cover is closed, a fastener to hold the cover on a golf bag when the club is in use, and protruding lip on the toe piece to facilitate a grasp to open the cover.

DRAWING

FIG. 6 is a cross sectional view of the cover of FIG. 4.

FIG. 7 is a side view of a cover suitable for an "iron" club.

FIG. 8 shows the cover of FIG. 7 being removed from the club head.

DESCRIPTION OF THE PREFERRED EMBODIMENT

Figure 1:
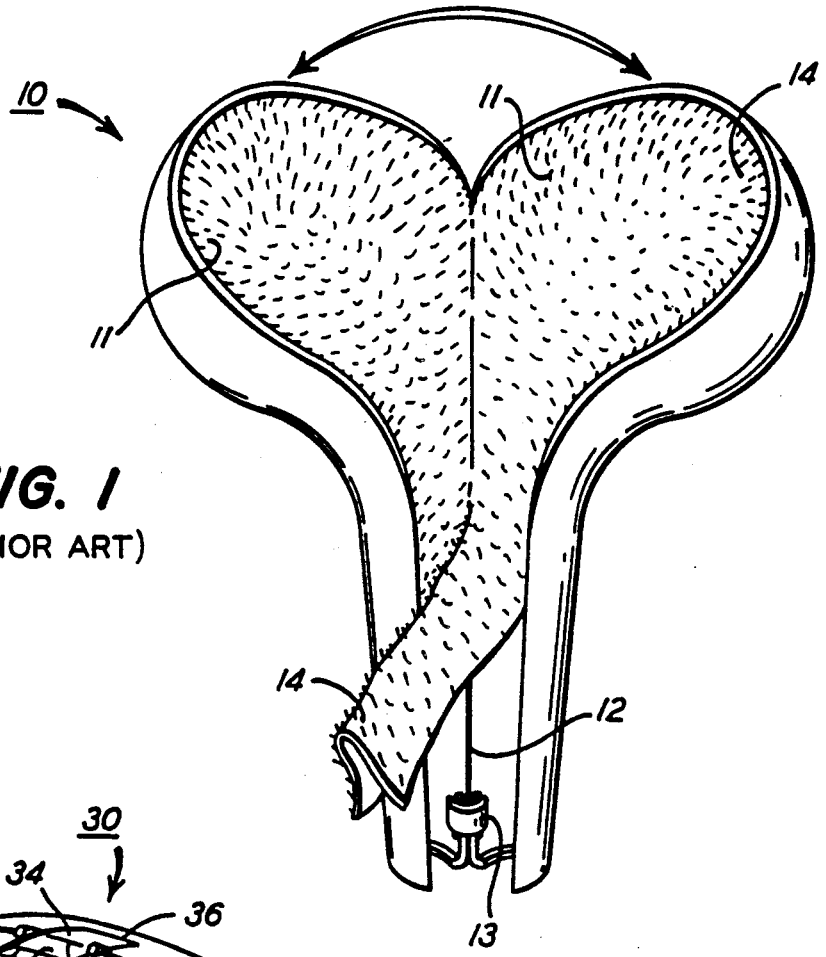
FIG. 1 (PRIOR ART)
FIG. 1 is an open front view of a prior art golf club cover.
Figure 2:
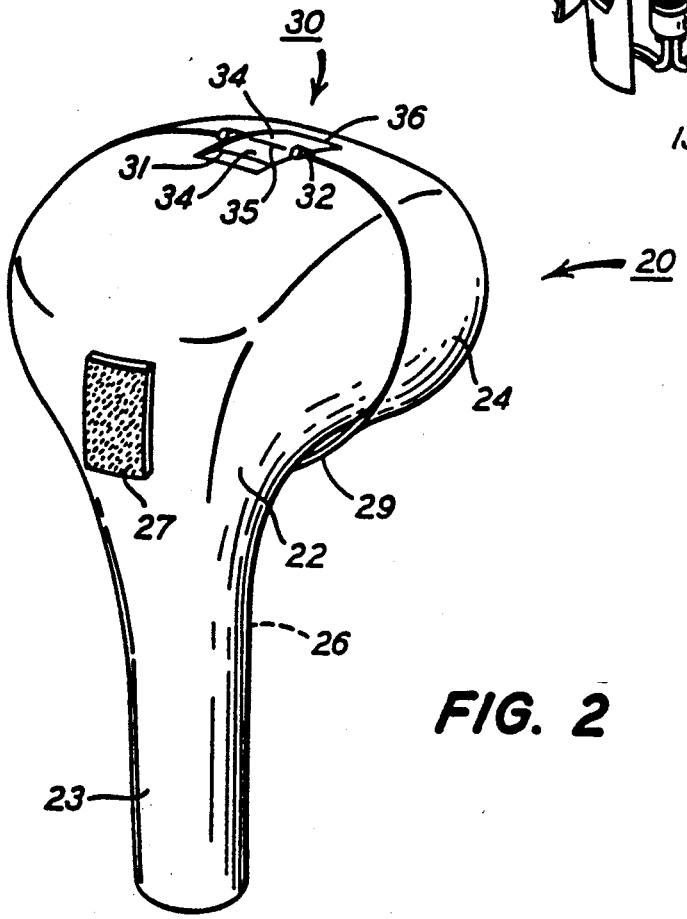
FIG. 2 is a rear perspective view of a golf club cover of this invention.

FIG. 1 shows a golf club cover 10 which is the closest prior art that I know of. The cover 10 has a hard plastic case 11 forming a cavity in the general shape of a club head. The case 11 includes two symmetrical halves, parted front and back parallel to the club shaft. The back of the case is hinged along the back parting line 12, the hinge including a number of spaced metal springs 13. The front of the case opens and closes to receive, release, or protectively encase a club head, as the case may be. The hard plastic case protects the club head against shock loading or impact. The cover 10 also includes a soft furry interior lining 14 for protection against scratches and the like. The metal springs 13 hold the cover 10 in its open position, and in its closed position. It requires two hands to manipulate this cover.

Reference is now to FIGS. 2–6 . A golf club cover according to this invention is generally indicated at 20. The cover is hard plastic case forming an internal cavity 21 (FIG. 6) in the general shape of the head and lower shaft of a "wood" golf club 40. The cover 20 includes a heel piece 22 and a toe piece 24 joined together by a top hinge 30. A leg portion 23 extends from the heel piece 22. The heel piece 22 and leg 23 are open lengthwise through a front aperture 26 to receive the head 41 and lower shaft 42 of the club 40 within the cavity of the cover 20.

Figure 3:
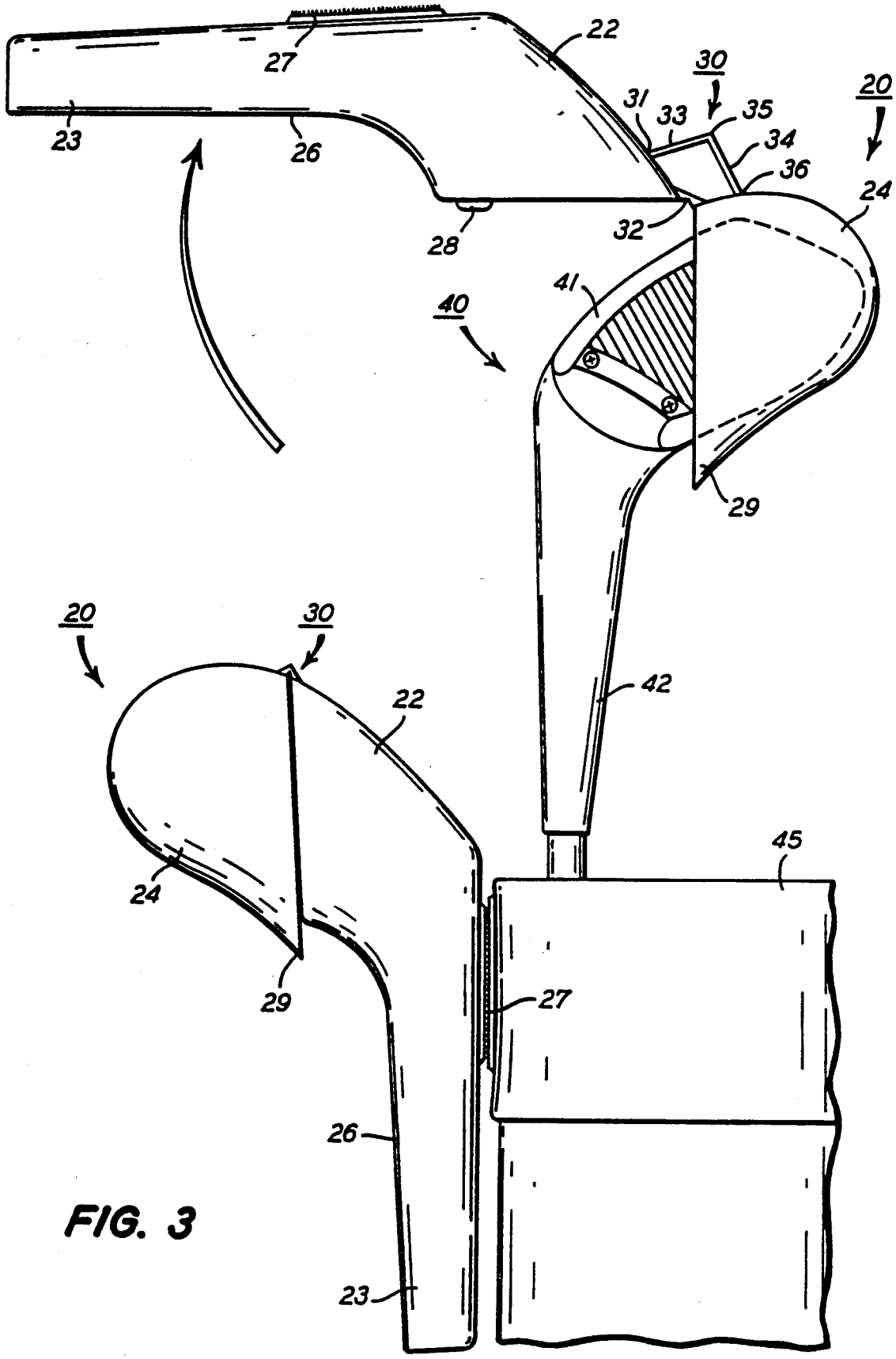
FIG. 3 is a side view of two such covers, one being removed from a club, and one mounted on the side of a golf bag.

FIG. 3 is a side view of two of the golf club covers 20. The cover at the upper right is on the head of a club 40 standing in a golf bag 45, and is being removed from the club. The heel piece 22 of the cover is swung away from the club as indicated by the arrow. Heel 22 and toe 24 are then simply lifted from the club head. The cover is then attached to the outside of the golf bag while the club is being used, as shown at the left, by fastening means such as mating Velcro strips 27 on the cover 20 and bag 45. The heel piece 22 of the cover includes a pair of guide tabs 28 which project slightly forward of the heel piece and into the toe piece 24 when the cover is closed. These guide tabs 28, one on each side if the heel piece 22, hold the heel and toe pieces in alignment and prevent lateral or twisting stress on the hinge 30.

Figure 4:
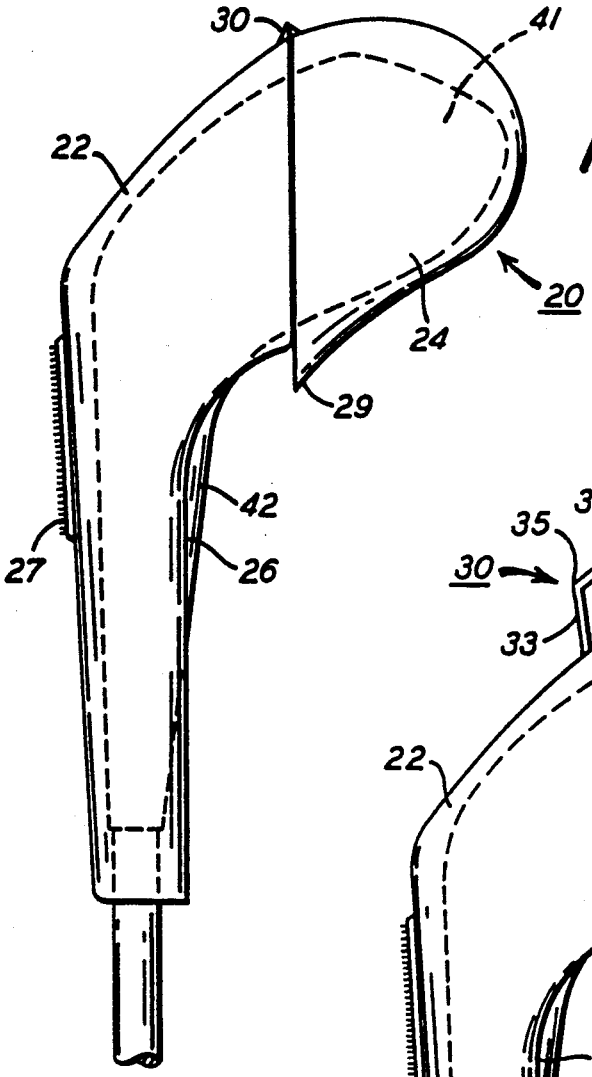
FIG. 4 is a side view of a cover mounted on a club head.
Figure 5:
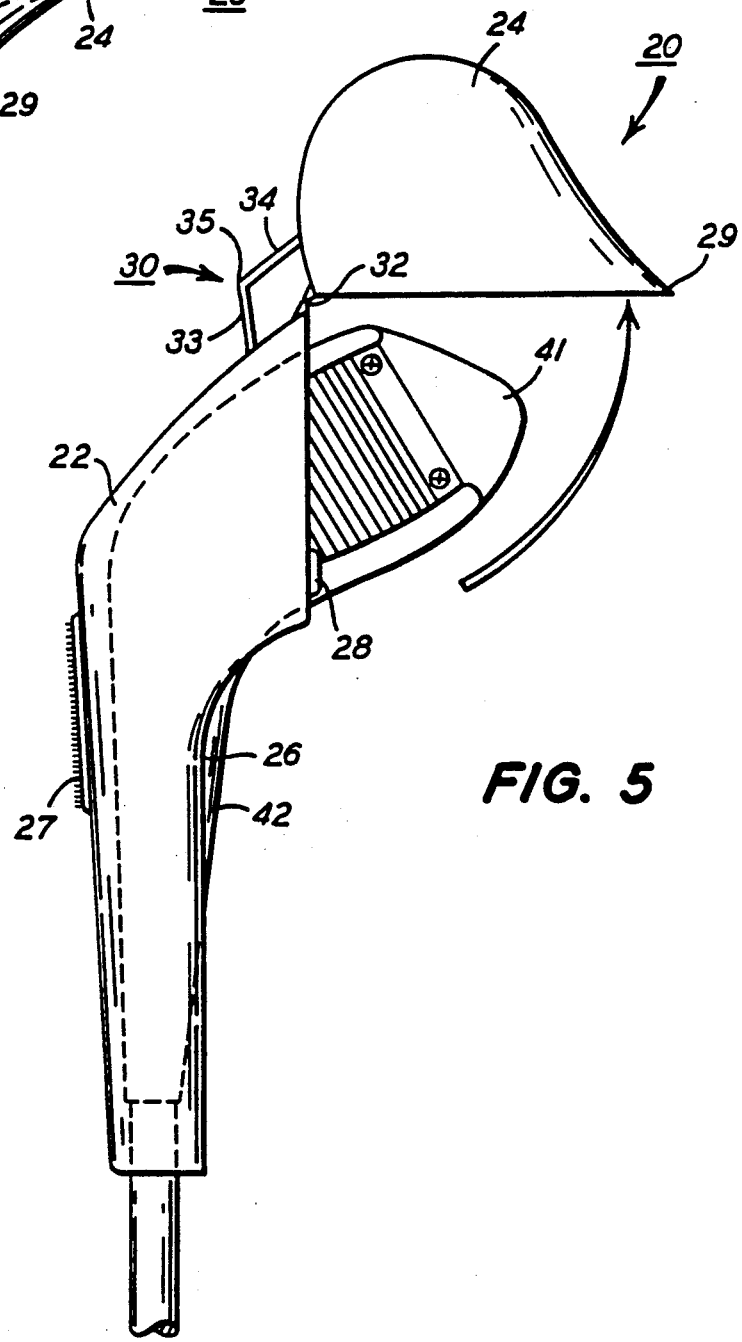
FIG. 5 shows the cover of FIG. 4 being removed from the club head.

FIGS. 4 and 5 show a cover 20 mounted on a club head 40 and being removed from it. In this case, the toe piece 24 is swung away from the club head, as indicated, and heel 22 and toe 24 removed. The toe piece 24 includes a protruding lip 29 for ease in grasping the toe piece. Whether the user manipulates the heel piece 22, as in FIG. 3, or the toe piece 24 as in FIG. 5, is simply a question of user convenience. FIG. 6 is a cross sectional view of the cover 20, showing its interior and the selective placement of interior pads 25 for further protection of the club head.

Reference is now primarily to FIGS. 3 and 5. The hinge 30 connecting the heel piece 22 and toe piece 24 includes a hinge web 32 forming the axis of the hinge connection of the heel and toe pieces, and a pair of hinge arms 33 and 34. Hinge arm 33 is resiliently connected to the heel piece 22 along a juncture line 31. Hinge 34 is resiliently connected to the toe piece 24 along a juncture line 36. Arms 33 and 34 are connected to each other at a resilient joint 35. When the cover 20 is closed, the hinge arms 33 and 34 are in a certain angular relationship, or what might be termed their "home position", with respect to each other. It requires force to move from the home position, and in the absence of an opening force, the arms 33 and 34 hold the cover 20 closed and in place on a club head. When the cover 20 is open, the hinge arms 33 and 34 are again in the same angular relationship, their home position, with respect to each other. Thus, with the cover 20 open, as with it closed, the hinge arms 33 and 34 stay in their home position and hold the cover 20 open unless a force is applied to close it. At positions between fully open and closed, i.e. at other than the home position of hinge arms 33 and 34, except at the dead center position, there is stress in the hinge tending to push it either open or closed. Because of this, the cover snaps into its position, open or shut as the case may be. The hinge 30 is preferably of polypropylene, the characteristic properties of which are that the hinge is a "living hinge" with an apparent unlimited duty cycle.

FIGS. 7 and 8 are side views of a cover 50 of this invention, suitable for an "iron" golf club 44. The cover 50 is a hard plastic case including mating pieces 52 and 54 joined together by a hinge 60 and forming an internal cavity 51 in the general shape of the head the club 44. Hinge 60 is the same as hinge 30 which has been described in more detail in connection with the cover 20 of FIGS. 2–6. In FIG. 7, the cover 50 is closed over the club head. In FIG. 8, the cover has been opened for removal from the club.

The cover 20 of FIGS. 2–6 and the cover 50 of FIGS. 7 and 8 are both operable with one hand. This is a significant convenience because it makes the other hand available to hold the club.

In the preferred embodiment of cover 20, as described, the heel piece 22 is open in the front to fit on the rear of the club. It is also possible, though not presently preferred, that the heel piece be open in the rear, to fit on the front of the club, with the toe 24 then being hinged at its "instep".

In another embodiment, the cover simply includes first and second concave pieces together forming a cavity for the club head, pieces connected by a hinge over the bottom of the golf club for opening and closing of the cover. As in the other embodiments, the hinge includes arms to selectively urge the cover pieces open or closed.

Certain anatomical terminology (toe, heel, leg) is adopted herein as an aid to reader orientation. The hinge 30 is however described as a top hinge with reference to its location on the "top" of the cover as it is shown in the drawings (rather than as a bottom hinge on the ball of the foot etc.). This terminology continues in the appended claims.

The foregoing description of preferred embodiments of this invention is intended as illustrative. The concept and scope of the invention are limited only by the following claims and equivalents thereof.

What is claimed is:

1. A cover for the head of a golf club, including a heel piece and a toe piece together forming an internal cavity for said club head, and a leg portion extending from said heel piece to engage the lower shaft of said club:

said heel piece and leg portion together defining a longitudinal front aperture along the length thereof to permit placement of said cover upon said shaft, and removal of said cover from said shaft, through said front aperture by lateral displacement of said covers relative to said club shaft;

said toe piece operatively connected to said heel piece by a transverse snap hinge on the top of said cover to selectively (i) open said cover for free ingress and egress of said club head, and (ii) close said cover to contain said club head;

said hinge including a hinge web on the axis thereof and a pair of articulated hinge arms operatively connected to each other and to said pieces to selectively urge said cover open and closed.

2. A cover as defined in claim 1 further including guide means to hold said heel and toe pieces in registry when said cover is closed; and fastening means to mount said cover to a temporary supporting surface when said cover is removed from said club.

3. A cover for the head of a golf club, including:

a heel piece including a leg portion extending therefrom, said heel piece and leg portion together defining a longitudinal front aperture along the length thereof to permit placement of said cover upon said shaft, and removal of said cover from said shaft, through said front aperture by lateral displacement of said cover relative to said club shaft; and a toe piece operatively connected to said heel piece by a transverse snap hinge on the top of said cover to selectively urge said cover (i) open for ingress and egress of said club head, and (ii) closed to contain said club head.

4. A cover as defined in claim 3 further including guide means to hold said heel and toe pieces in registry when said cover is closed: and fastening means to mount said cover to a temporary supporting surface when said cover is removed from said club.

* * * * *